United States Patent [19]

Ayers

[11] 4,035,962

[45] July 19, 1977

[54] ZIRCON SAND IMPACTING MATERIAL

[76] Inventor: Joseph W. Ayers, c/o The Ayers Company, R.D. No. 2, Bethlehem, Pa. 18017

[21] Appl. No.: 637,117

[22] Filed: Dec. 3, 1975

Related U.S. Application Data

[62] Division of Ser. No. 413,818, Nov. 8, 1973, Pat. No. 3,939,613.

[51] Int. Cl.[2] ..... C09G 1/02

[52] U.S. Cl. ..... 51/308; 51/320

[58] Field of Search ..... 51/309, 293, 308, 319, 51/320

[56] References Cited

U.S. PATENT DOCUMENTS

| | | | |
|---|---|---|---|
| 2,694,004 | 11/1954 | Coffeen | 51/308 |
| 2,877,104 | 3/1959 | Robie | 51/308 |
| 2,955,030 | 10/1960 | Baldwin et al. | 51/308 |
| 3,541,017 | 11/1970 | Muhler | 51/308 |

*Primary Examiner*—Donald J. Arnold

*Attorney, Agent, or Firm*—Curtis, Morris & Safford

[57] ABSTRACT

The treatment of hard surfaces by impacts of fine hard granules continually bombarded against them, as for peening, brightening, texturizing, compacting, reforming and/or cleaning adhesions from plates and other articles of steel, aluminum, or hard plastics, is accomplished with extraordinary effectiveness, yet with minimal loss of the blasting material due to breakdown, by providing and utilizing for the treatments selectively sized fractions having grain sizes limited to the ranges of −100/+200 mesh, −100/+140 mesh, −140/+200 mesh and −200/+325 mesh grain sizes, of the rounded oblong grains, having a specific gravity of about 4.7, of a mass of refined zircon sand.

5 Claims, 2 Drawing Figures

62.5 X 62.5 X

ZIRCON SAND IMPACTING MATERIAL

Figure 1:
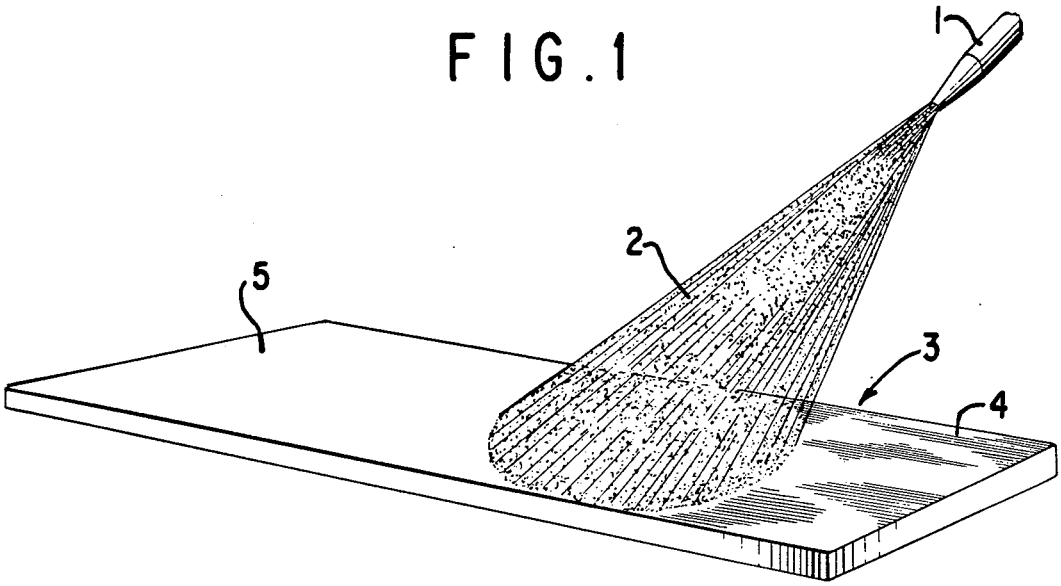

This is a division of my copending application, Ser. No. 413,818 filed Nov. 8, 1973 now U.S. Pat. No. 3,939,613. This invention relates to a material and process for the treatment of hard surfaces by impacts and, more particularly, for peening, brightening, texturizing, compacting, reforming and/or removing burrs, scale or other adhesions from the surfaces of articles, made of metals, ceramics, refractory materials, or hard plastics, by bombardment of them with fine grains of the material hurled against them at high velocity.

This manner of treatment of hard surfaces is analogous to sand blasting in that hard grains are hurled against a hard work surface by a blasting apparatus uitlizing a jet of compressed air or other suitable fluid, such as a liquid or a gas or vapor, or utilizing centrifugal force, for propulsion of the granular material. In impacting processes for the treatment of finished hard articles, or for improving the structure of hard surfaces, it is important to utilize a fine hard material which, unlike common sand and other truly abrasive grits, will not cut into the surface structure of the impacted work pieces.

Among the many materials which have been proposed for use in such processes are microscopic glass beads, hard nutshell granules, extra-fine grades of silica sand and spherical particles of zirconia ($ZrO_2$) or of mixed zirconia and silica. Microscopic glass beads have largely supplanted the other materials known for such use. These beads have sizes selected within close limits which desirably differ for different types of work, or for surfaces to be treated that have different hardnesses, but which in general are within the range of from about 0.0005 inch up to about 0.05 inch in bead diameters.

Microscopic glass beads, however, have a limited capacity to apply kinetic energy to the impacted surfaces, and they are troublesome and costly in use because they tend to break down and thus to lose effectiveness under the shocks of the continual impacts at high velocity. Consequently, various expedients have been proposed for either inhibiting the break-down tendency of the beads or alleviating troubles that result. For instance: According to U.S. Pat. No. 3,019,522, the glass beads are propelled in suspension in a liquid carrier. According to U.S. Pat. No. 3,225,495, they are pre-coated with a thin layer of a cured thermosetting resin to inhibit breakdown. According to U.S. Pat. No. 3,425,250, special equipment is provided for removing broken beads and glass dust from the mass of beads supplied to the blasting apparatus.

The principal object of the present invention is to provide a material for the high velocity impact treatment of hard surfaces, by which the required treatments may be effected, and by which improved peening, brightening, texturizing, compacting, reforming and/or cleaning effects may be obtained, with avoidance of much of the inefficiency that attends the use of glass beads and of other known impacting materials.

It has been discovered that this object can be attained by providing for and utilizing in the impact treatment selectively sized fine grains of refined zircon sand. This particular material has been found to possess a distinctive combination of properties, including rounded oblong grain configurations, high density, great hardness and excellent break-down resistance, which enable it to be used with extraordinary effectiveness as a surface impacting agent.

Zircon sand in its naturally occurring condition is not satisfactory for the purposes of the invention. It can be made satisfactory, however, by concentrating it away from other minerals with which it occurs in nature, as by screening, air tabling, flotation and other separation processes, and then refining the concentrate by washing it, treating it with sulfuric acid or roasting it to rid the grains of objectionable foreign matter. Then a suitably sized collection or fraction of the substantially pure zircon sand grains is obtained, for example by selective screening operations, from the resulting mass of refined zircon sand.

The range of zircon sand grain sizes to be employed for optimum impacting effects depends upon the particular work being performed and the hardness qualities of the surface of the work piece. Thus, for some purposes, such as for peening or texturizing relatively soft metal surfaces, such as surfaces of aluminum plates or sheets, extremely fine zircon sand grains in the sieve size range of minus 200 to plus 325 mesh are especially advantageous. Further, for many purposes of the invention the most advantageous sizes of the zircon sand grain may be those which will pass through a 100 mesh sieve and be retained on a 200 mesh sieve, and for special uses these may be classified into still narrower fractions such, for example, as −100 to +140 mesh sizes and −140 to +200 mesh sizes. The corresponding grain widths extend from 0.0059 inch, or 0.149 mm., to 0.0029 inch or 0.074 mm. for the −100 to +200 mesh range, while the grain widths corresponding to the very fine −200 to +325 mesh range extend from the size last stated to 0.0017 inch or 0.044 mm.

Zircon sand is a naturally occurring form of the mineral zircon, the zirconium orthosilicate, $ZrSiO_4$. The known deposits of it have been found principally in certain beach areas in the states of Florida and Georgia and in Australia, Greenland, Uruguay, Brazil and Canada. The grains of this sand are generally quite fine in size and are extraordinarily hard and tough, having a Moh's hardness of about 7.5 which is about 15% to 45% greater than the Moh's hardness measurements of the glass beads most commonly used for impact treatment. Although they are not spherical, zircon and grains have a characteristic rounded oblong configuration with smoothly rounded convex edges and end contours and remarkably few sharp edges. This form enables them to act in some respects like spherical granules when they are hurled at a high velocity against surfaces to be treated. In addition, they posses a very high density, having a specific gravity which is greater even than the specific gravity of 4.49 possessed by specialty beads of leaded glass and is nearly twice the specific gravity of 3.48 possessed by the glass beads, made of (standard soda lime) crown glass most commonly used for impact treatment.

It has been found that the fine zircon sand grains can be employed with extraordinary effectiveness for peening, brightening, texturizing and/or removing adhesions from hard surfaces such as metal surfaces by bombardment of the grains against the work pieces. For a given blasting velocity these grains exert a far greater impacting force than do similarly sized crown glass beads, while their rounded contours accompanied by very few sharp edges enable this force to be exerted without objectionable cutting or tearing of the impacted surface. Also, due to their great hardness and structural density, the impacting zircon sand grains transmit their kinetic energy efficiently to the work piece with relatively little dissipation of the energy through elastic deformation of the granules, and their resistance to bread-down or fracture and wear is so great that they can be kept in efficient use for extraordinarily long periods of service.

By virtue of those combined properties, the treatment of metal surfaces by high velocity bombardment of them with extremely fine sizes of zircon sand grains, such as sizes in the −200 to +325 mesh range, offers exceptional advantages over the use of correspondingly sized glass beads or of any other known non-metallic impacting material.

The fine zircon sand grains provide still other advantages over the use of glass beads by virtue of their properties of thermal stability and chemical inertness. They remain solid at temperatures up to 1500° C. They have such a low coefficient of thermal expansion, which is less than that of fused quartz, that they can be used effectively for impact treatments at any atmospheric temperature, including subfreezing temperatures, and even at highly elevated temperatures; whereas glass beads soften at corresponding elevated temperatures and become embrittled at low temperatures. Also, they are highly inert to the chemical influences of water, of organic liquids and solvents, and of most acids and alkalis, so that they can be used without impairment under great varieties of working conditions. Still further, the use of them does not present the health hazards to workmen which are involved in the use of glass beads.

In the accompanying drawings:

FIG. 1 is a schematic illustration of an air blasting nozzle 1 being used for the projection of a stream 2 of fine zircon sand grains at a high velocity against the surface of an aluminum plate 3. A portion 4 of the original, untreated metal surface is shown as having a spectacular sheen such as that which results from the extrusion of aluminum, which is desirably to be altered by the impact treatment, and a portion 5 of the metal surface is shown schematically as having an evenly texturized condition of high integrated reflectance quality imparted to it by the impacts of very fine zircon sand grains.

Figure 2:
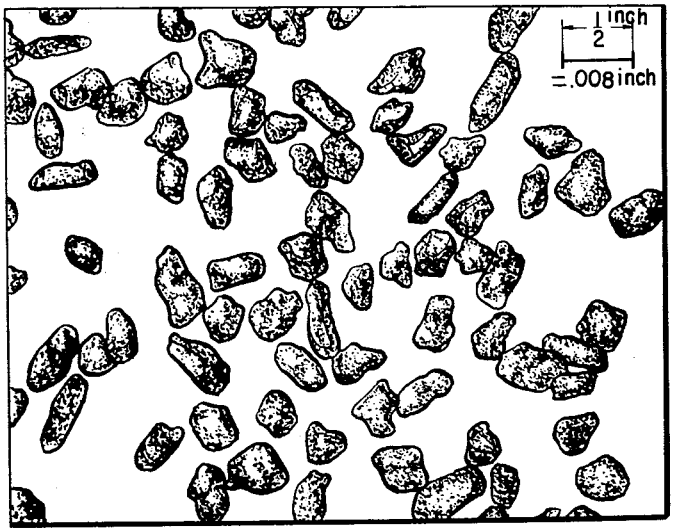

FIG. 2 is a greatly enlarged (62.5×), hand drawn illustration of the grains of a typical sample of washed and roasted Georgia zircon sand fractionated by screening to fine grain sizes in the range of −100 mesh to +200 mesh, as prepared for use according to the invention. The scale line drawn on this figure represents a distance of 0.008, which approximately corresponds to the length of many of the zircon sand grains but is greatly in excess of their width.

For the preparation of the required material, a mass of zircon sand concentrated away from other minerals naturally occurring with the sand may be washed with water to remove water soluble foreign matter and then, before being screened to the required size range or ranges, may be roasted at a temperature sufficiently high to burn off organic foreign matter remaining on or among the zircon sand grains. The roasting temperature should be in the range of 300° to 800° C.

The effectiveness of the invention for imparting surface texture to aluminum metal plates, as compared with the use of glass beads air blasted against the work piece in the same manner for the same purpose, has been demonstrated by tests in which the undulations produced in the impact-treated aluminum surfaces were measured by use of a Proficorder. Three aluminum plates were blasted with each impacting material for three different periods of time, namely, 5 seconds, 10 seconds and 15 seconds, and the depths of the surface undulations produced were measured and averaged to obtain comparative data. The results were as shown in Table I below. The magnitude of the average undulus index indicates the relative depth of the surface undulations producted by the treatment and thus is an indication of the extent of reduction of the specular sheen, or glare quality, of the surfaces treated.

TABLE I

| Impact Treatment (Texturizing) Impacting Material | Proficorder Undulus Index (Average) |
|---|---|
| TR-132 Glass beads −200 to +325 mesh | 2.53 |
| TR-131 Zircon sand −200 to +325 mesh | 4.13 |
| TR-133 Glass beads −100 to +200 mesh | 3.70 |
| TR-120 Ziron sand −100 to +200 mesh | 4.50 |

Another attribute of the treatment with fine zircon sand as herein disclosed is that it at least equals, and in many cases, excels, the performance of glass beads in regard to the overall luster or brightness of the impacted, texturized metal surfaces. This effect is illustrated by "Color Eye" evaluations of the brightness, or integrated reflectance values from all angles, of the treated aluminum surfaces referred to in Table I; also by like evaluations of surfaces of steel plates after they were impacted with the same materials in the same manner though by longer intervals of blasting.

Table II below shows the data obtained by these evaluations. The values relate to a standard reflectance of 100 exhibited by magnesium oxide. For comparison, this table also shows data from like evaluation of the integrated reflectance values of corresponding metal surfaces treated in the same manner with two commonly used blasting abrasives, namely, a commercial alumina of very fine particle size and a fine "00" grade of high purity silica sand. These latter abrasives, however, break down so rapidly under high velocity impacts against hard surfaces that they would not be commercially suitable for the purposes of the present invention even if they were comparable to glass beads in effectiveness.

TABLE II

| A. Aluminum Plates (6061 T-6 Al) | Integrated Reflectance (By "Color Eye") | | |
|---|---|---|---|
| Impacting Material | Blasting Time | | |
| | 5 sec. | 10 sec. | 15 sec. |
| Alumina T-61 | 29.6 | 32.3 | 35.0 |
| Blasting sand (Waldron 00 grade) −200 to +325 mesh | 47.9 | 42.5 | 43.7 |
| Glass beads (MS-M) −100 to +200 mesh | 52.6 | 48.7 | 47.6 |
| Zircon sand (Tr-120) −100 to +200 mesh | 55.3 | 51.6 | 53.6 |
| Glass beads (MS-L) −200 to +325 mesh | 57.7 | 57.5 | 51.0 |
| Zircon sand (TR-131) −200 to +325 mesh | 60.5 | 58.3 | 59.7 |
| B. Impacted Steel Plates (MS-1045, Rockwell hardness 95) | 30 sec. | 60 sec. | 2 min. |
| Alumina T-61 | 13.2 | 13.3 | 14.8 |
| Blasting sand (Waldron 00 grade) | 24.1 | 20.2 | 21.4 |
| Glass beads (MS-M) −100 to +200 mesh | 18.3 | 20.6 | 22.7 |
| Zircon sand (TR-120) | 28.3 | 31.6 | 31.9 |

TABLE II-continued

| | | | |
|---|---|---|---|
| −100 to +200 mesh | | | |
| Glass beads (MS-L) −200 to +325 mesh | 18.3 | 19.4 | 20.3 |
| Zircon sand (TR-131) −200 to +325 mesh | 30.5 | 30.3 | 31.3 |

The aluminum and the steel plate surfaces impacted with the fine alumina abrasive were dull and dark grey in color. Those impacted with the fine silica blasting sand were much lighter and in the case of steel compared well with those impacted with glass beads; but they were considerably inferior to the latter in the case of aluminum. The greatest overall reflectance values, or brightness, was produced for both metals by the treatments with zircon sand, as was particularly evident from inspection of the treated steel plates and in the case of the aluminum plates impacted with the extremely fine (200/325 mesh) fraction of zircon sand.

A most important attribute of the present impacting material is found in the fact that the fine grains of refined zircon sand will exert an impacting force, or kinetic energy, approximately twice as great as that obtained from glass crown beads of the same size at the same blasting velocity, yet, even with this extraordinarily great impacting force, the zircon sand grains exhibit a breakdown resistance, or wear life, significantly superior to that of glass beads.

Table III below shows the results of wear life tests in which the same weighed quantities of three different materials were used, each for a specified period of time and under the same conditions as the others, for blasting the surface of a plate of mild steel having a Rockwell B scale hardness of 91–94, after which the amount of each material broken down to sizes smaller than 325 mesh sieve size was determined as a percentage of the original weight of the material used. The three materials, namely, (1) a blasting sand of Waldron 00 grade, (2) glass beads of grade MS-L produced by Microbeads Division of Cataphote Corporation, and (3) a −200 to +325 mesh fraction of refined Georgia zircon sand, were each composed of grain in the −200 to +325 mesh size range.

The tests were conducted in a Ruemelin demonstration blasting cabinet measuring 18 × 24 × 13 inch in size, which was equipped with a vacuum type dust collector and with a ⅜ inch × 2 inch blasting nozzle hving a 3/16 inch jet orifice. The nozzle was positioned 3 inches away from the surface of the steel plate, at an angle of 60° thereto. Tests were conducted at nozzle pressures of 50 p.s.i., 75 p.s.i. and 100 p.s.i., and for periods of 1 minute, 3 minutes and 5 minutes with each material. After each test period, blasting was discontinued and the portions of the material remaining in the cabinet and in the dust collector were collected and screened to separate the content of −325 mesh particles. This was weighed to determine the extent of breakdown. Screening was effected by use of a Ro-tap screening machine. The resulting wear-life test data are as follows:

TABLE III

| | | Percent Breakdown After Specified Blasting Period | | |
|---|---|---|---|---|
| Nozzle Pressure | Blasting Time | Blasting Sand −200 to +325 mesh | Glass Microbeads MS-L | Zircon Sand −200 to +325 mesh |
| 50 psi | 1 min. | 16.30% | 4.52% | 1.60% |
| | 3 min. | 17.00% | 4.92% | 3.18% |
| | 5 min. | 21.90% | 4.72% | 5.34% |
| 75 psi | 1 min. | 16.00% | 5.37% | 1.82% |
| | 3 min. | 27.60% | 6.62% | 4.96% |
| | 5 min. | 38.30% | 7.07% | 6.88% |
| 100 psi | 1 min. | 30.60% | 3.56% | 1.76% |
| | 3 min. | 45.20% | 6.25% | 5.37% |
| | 5 min. | not determined | 8.00% | 8.32% |

Since the same weighed quantities of the impacting materials were used in the above tests, namely, 2,000 grams for each test, the volume of the zircon sand grains subjected to the tests was much smaller than the volume of the glass beads subjected thereto and, accordingly, the individual grains of the zircon sand were subjected, especially in the longer test periods, to far more numerous impacts than the individual glass beads.

What is claimed is:

1. A material for treating hard surfaces by being continually hurled at high velocity against such surfaces, consisting essentially of a selectively sized fraction of the fine grains of a mass of refined zircon sand, said grains having rounded oblong configurations and having a specific gravity of about 4.7 and their sizes being in a range selected from the group consisting of −100 to +200, −100 to +140, −140 to +200 and −200 to +325 mesh size ranges.

2. A material according to claim 1, the sizes of said grains being in the range of from −100 Mesh to +200 mesh sieve sizes.

3. A material according to claim 1, the sizes of said grains being in the range of from −100 mesh to +140 mesh sieve sizes.

4. A material according to claim 1, the sizes of said grains being in the range from −140 mesh to +200 mesh sieve sizes.

5. A material according to claim 1, the sizes of said grains being in the range of from −200 mesh to +325 mesh sieve sizes.

* * * * *